United States Patent [19]

Holden

[11] 4,442,969

[45] Apr. 17, 1984

[54] REINFORCED PACKAGING TRAY

[75] Inventor: M. James Holden, Canandaigua, N.Y.

[73] Assignee: Mobil Oil Corporation, New York, N.Y.

[21] Appl. No.: 489,636

[22] Filed: Apr. 28, 1983

[51] Int. Cl.[3] ..... B65D 1/34; B65D 1/44

[52] U.S. Cl. ..... 229/2.5 R; D7/359; D9/425; 220/72; 229/3.5 MF

[58] Field of Search ..... 229/30, 2.5 R, 3.5 MF; D7/359; D9/341, 425, 456; 99/425, 445, 446; 220/71, 72, 66; 206/557, 561; 426/119, 129, 77

[56] References Cited

U.S. PATENT DOCUMENTS

| | | | |
|---|---|---|---|
| 28,014 | 4/1860 | Scaife | 220/72 |
| D. 184,525 | 3/1959 | Lurie | D44/10 |
| D. 209,605 | 12/1967 | Zoeller et al. | D44/1 |
| D. 226,775 | 4/1973 | Jones | D9/425 X |
| D. 226,838 | 5/1973 | Ruskin | D9/4 |
| D. 228,861 | 10/1973 | Melich | D7/1 |
| D. 240,714 | 7/1976 | White | D9/3 |
| D. 267,221 | 12/1982 | Williams | D7/359 |
| 1,727,011 | 12/1925 | Heileman . | |
| 2,058,662 | 10/1936 | Broeg | 229/3.5 MF X |
| 2,272,371 | 2/1942 | Weiner | 217/26.5 |
| 2,655,283 | 10/1953 | Moldt | 220/22 |
| 2,920,805 | 1/1960 | Reifers | 229/2.5 R |
| 3,067,921 | 12/1962 | Reifers | 229/2.5 |
| 3,151,799 | 10/1964 | Engles, Jr. et al. | 229/2.5 |
| 3,155,303 | 11/1964 | Fenkel | 229/2.5 |
| 3,480,178 | 11/1969 | Morgan | 229/2.5 R |
| 3,485,434 | 12/1969 | Donovan et al. | 229/2.5 R |
| 3,583,623 | 6/1971 | Golner | 229/2.5 |
| 3,675,811 | 7/1972 | Artz | 220/20 |
| 3,682,365 | 8/1972 | Reifers et al. | 229/2.5 |
| 3,756,492 | 9/1973 | Reifers et al. | 229/2.5 |
| 3,764,057 | 10/1973 | Reifers et al. | 229/2.5 |
| 3,845,896 | 11/1974 | Crabtree | 229/2.5 |
| 3,894,679 | 7/1975 | Reifers et al. | 229/2.5 |
| 3,926,363 | 12/1975 | Catron | 229/2.5 |
| 3,937,389 | 2/1976 | Wind | 229/2.5 |
| 3,958,504 | 5/1976 | Levin | 229/3.5 MF X |
| 4,120,398 | 10/1978 | Braddon, Sr. | 206/408 |
| 4,349,146 | 9/1982 | Holden | 229/2.5 R |

FOREIGN PATENT DOCUMENTS

| | | | |
|---|---|---|---|
| 7603016 | 5/1977 | Netherlands | 426/77 |

*Primary Examiner*—William Price
*Assistant Examiner*—Gary E. Elkins
*Attorney, Agent, or Firm*—A. J. McKillop; M. G. Gilman; J. F. Powers, Jr.

[57] ABSTRACT

Disclosed is a packing tray having an improved rib reinforcement. At least one tapered rib extends along the bottom of the tray from a longitudinal centerline portion toward opposing sidewalls. The rib cross-section progressively decreases from the centerline portion toward the terminating end of the rib. The tapered rib provides tray reinforcement where it is most needed while minimizing intrusion into available packaging volume.

20 Claims, 9 Drawing Figures

REINFORCED PACKAGING TRAY

BACKGROUND OF THE INVENTION

1. Field of the Invention

The present invention relates to packaging trays for use in holding food items and, more particularly, relates to a rib reinforced plastic packaging tray, such as used for packaging meat, poultry, fish and other foodstuffs in a supermarket.

2. Discussion of the Prior Art

Plastic packaging trays are widely used in the food processing industry as a convenient and economical way to handle and sell various food items, such as meats, poultry and fish. To keep tray cost to a minimum, it is desirable to decrease wall thickness of the tray as much as possible, but this is limited by the strength which is required of the tray to reliably support and hold a particular item. Heavy items, such as meats, poultry and fish naturally require relatively thick wall structures to ensure they have a sufficient resistance to deflection and bending stresses.

To help reduce wall thickness, while preserving strength, many packaging trays employ strengthening reinforcing ribs at their bottoms and/or sides. However, typical reinforcing ribs have uniform height and width dimensions and extend substantially from tray sidewall to tray sidewall, causing a considerable loss of useable tray volume for packaging food items. Moreover, the ribs do not always provide a sufficient strengthening of the tray, particularly in the larger so-called family pack trays.

SUMMARY OF THE INVENTION

The present invention is designed to overcome the foregoing problems and provides a unique packaging tray construction employing reinforcing ribs, which minimizes loss of internal tray volume, while providing a high strength thin-wall construction.

Accordingly, one object of the invention is the provision of a packaging tray having integral reinforcing ribs at the tray bottom which impart a high degree of strength to the tray in the areas where resistance to deflection and bending stress is required, while minimizing wall thickness and intrusion into the useable packaging volume of the tray.

Another object of the invention is the provision of a packaging tray having integral reinforcing ribs at the tray bottom wherein the ribs are constructed and arranged such that their maximum reinforcement potential is located where it is most needed and the reinforcement potential is reduced at locations where it is less needed.

Another object of the invention is the provision of a packaging tray having at least one integral reinforcing rib extending along the tray bottom, with each rib being tapered in height and/or width and having a maximum cross-sectional area at a centerline portion of the tray bottom and a progressively decreasing cross-sectional area as it extends away from the centerline.

Another object of the invention is the provision of a packaging tray having a plurality of integral reinforcing ribs spaced about and extending along the tray bottom, with each rib being tapered in height and/or width from a centermost portion thereof to its terminating ends.

The above objects, advantages and features, and others, of a packaging tray constructed in accordance with the teachings of the invention will be more readily apparent from the following detailed description of the invention which is provided in connection with the accompanying drawing.

DETAILED DESCRIPTION OF THE INVENTION

Figure 1:
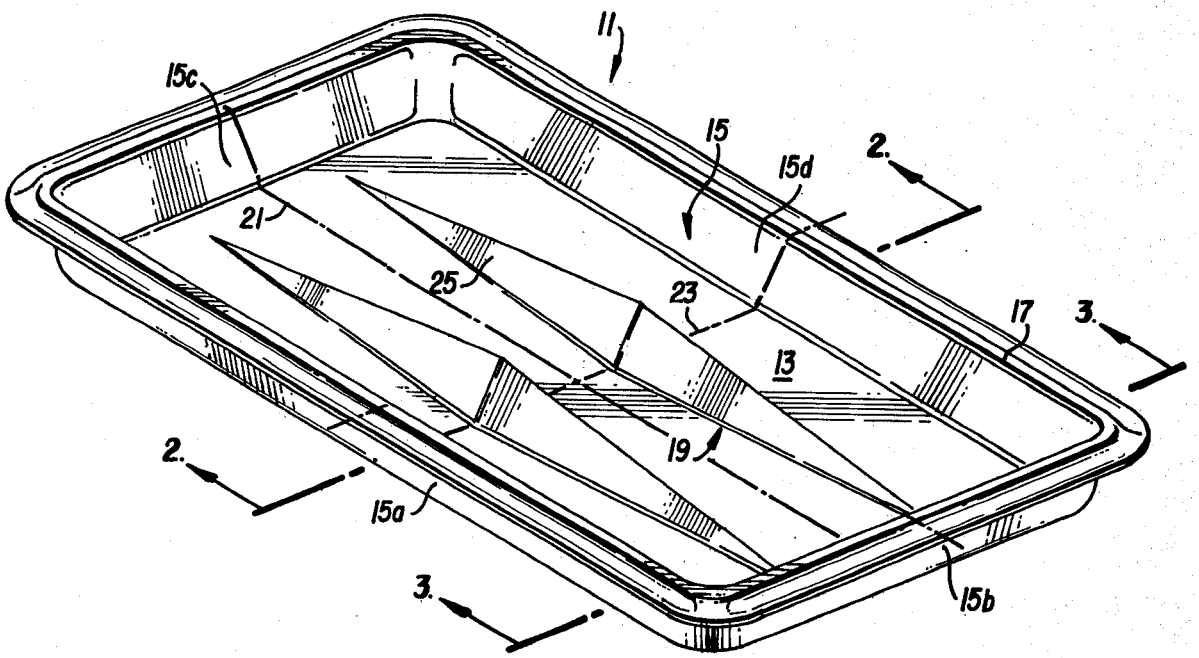
FIG. 1 is a perspective view of a first embodiment of a packaging tray of the invention.
Figure 2:
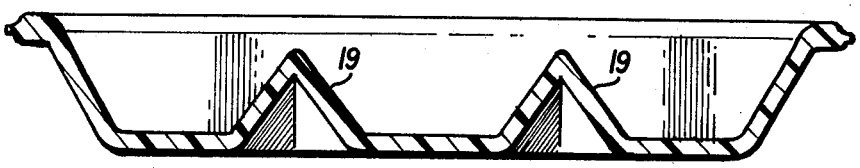
FIG. 2 is a cross-sectional view along the lines 2—2 in FIG. 1.
Figure 3:
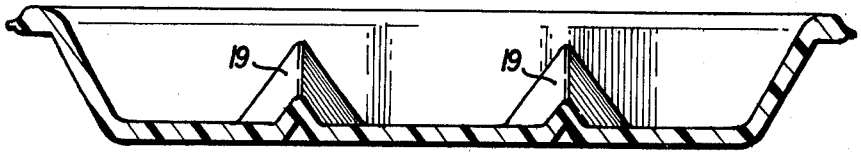
FIG. 3 is a cross-sectional view along the lines 3—3 in FIG. 1.

FIGS. 1–3 show a first embodiment of a packaging tray constructed in accordance with the teachings of the invention. The tray 11 has a generally rectangular shape and includes a bottom 13 and upstanding sidewalls 15 (15*a* . . . 15*d*) provided at the edges of the bottom. The upstanding sidewalls 15 are of substantially the same height and are connected at their longitudinal ends to form an integral wall structure surrounding the bottom and have near their uppermost surfaces an outwardly extending lip 17.

The bottom 13 of the tray contains one or more upwardly extending and tapered integral reinforcing ribs 19 extending from a longitudinal centerline 23 in opposite directions towards opposing sidewalls 15*b* and 15*c*. As the ribs 19 extend towards the sidewalls 15*b* and 15*c*, they are uniformly reduced in cross-sectional area, the cross-sectional area being that area occupied by the protusion of the rib from the surface of bottom 13. The cross-sectional dimension of the ribs 19 thus tapers and decreases from the centerline 23 towards the termination of the ribs. As shown, the tapered ribs 19 preferably terminate short of the sidewalls 15*b* and 15*c*. FIGS. 1–3 show two ribs located symmetrically about the widthwise centerline 21 of the tray. However, other rib arrangements can be employed, such as a single rib extending along centerline 21 or three or more ribs symmetrically arranged about centerline 21, depending on the tray strength desired.

The ribs 19 are oriented along the greater rectangular length direction of tray bottom 13 to accommodate the greater bending stresses of the tray which occur in this direction, particularly at and near the tray center where the bending stresses are maximum. The ribs 19 are sufficient to impart the necessary structural strength to the tray at the centermost portion along centerline 23 where it is most needed.

The cross-sectional dimension of the ribs 19 may be reduced by tapering the height and/or the width of the ribs 19 as they approach the opposing sidewalls 15*b* and 15*c*. The ribs illustrated in FIGS. 1–3 have both a height and width reduction, as clearly seen in the cross-sectional views in FIGS. 2 and 3.

Although the ribs 19 have a cross-sectional triangular profile, other profiles may be used, such as rounded, trapezoidal, rectangular, etc., the important aspect being that the cross-section of the ribs decreases, as the distance increases from the centerline of the tray.

The rib construction illustrated provides the greatest degree of reinforcement where it is most needed, namely at the longitudinal tray center and less reinforcement at those portions of the tray, removed from the tray center, where it is needed less. Accordingly, the tapering ribs 19 minimize intrusion into the available volume of tray 11 and provide a greater internal volume for food packaging. The tray illustrated in FIGS. 1–3 can be constructed out of polystyrene, using conventional thermal forming and molding techniques.

The rib design illustrated in FIGS. 1–3 is most useful for tray sizes where the tray length (length along centerline 21) significantly exceeds the tray width (length along line 23), e.g., 15"×8", etc. However, the illustrated rib construction could be used to improve the strength properties of trays of other length-to-width proportions.

A tapered rib packaging tray constructed as illustrated in FIGS. 1–3 was strength tested against two similar trays, one having a flat bottom with no reinforcing ribs, and the other having four uniform cross-sectional rounded bottom ribs extending along the tray length substantially from sidewall to sidewall (similer to the rib design of the commercially available Western Foam Pak 23S tray). All test trays had the same size (8"×15"), thickness and sidewall angle and were prepared using the same materials and thermoforming and molding processing conditions.

Strength testing was performed with an Instron strength tester and the results are summarized as follows:

TABLE I

| | MAXIMUM LOAD (lbs) | STIFFNESS (lbs/in) |
|---|---|---|
| CENTER BEND | | |
| Flat Bottom Tray | 3.6 | 7.7 |
| Tray with Uniform Profile Ribs | 3.9 | 8.2 |
| Tapered Rib Tray | 6.1 | 9.4 |
| CORNER BEND | | |
| Flat Bottom Tray | 1.7 | 1.1 |
| Tray with Uniform Profile Ribs | 1.8 | 1.0 |
| Tapered Rib Tray | 1.8 | 1.1 |

Average volume measurements for 10 trays of each design were also taken and these results are as follows:

TABLE II

| | VOLUME (Fl. Oz.) |
|---|---|
| Flat Bottom Tray | 25.1 |
| Tray with Uniform Profile Ribs | 24.7 |
| Tapered Rib Tray | 24.2 |

As evident from the foregoing, the packing tray constructed in accordance with the teachings of the invention provides a greatly enhanced structural rigidity and strength for the tray, while still minimizing intrusion into available volume.

Other embodiments of the invention are shown in FIGS. 4 through 9.

Figure 4:
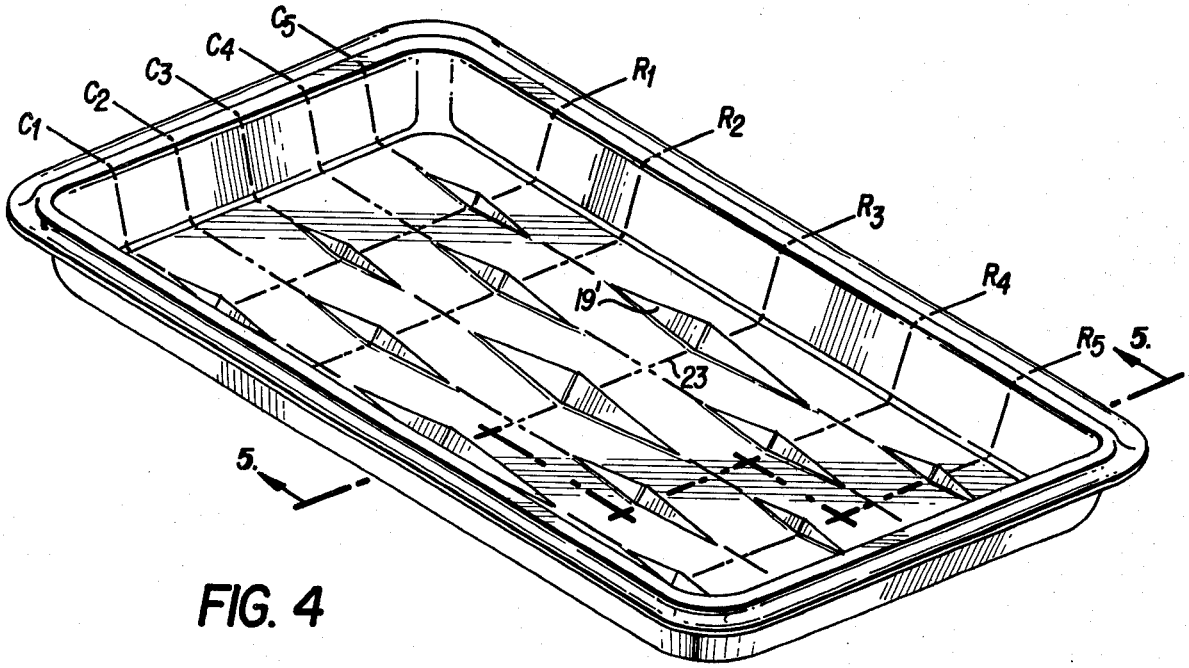
FIG. 4 is a perspective view of a second embodiment of a packaging tray of the invention.
Figure 5:
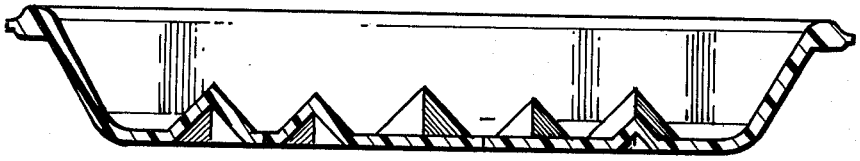
FIG. 5 is a cross-sectional view along the lines 5—5 in FIG. 4.

FIGS. 4 and 5 illustrate an embodiment which employs a plurality of tapered ribs 19' spaced in rows $R_1$ . . . $R_5$ and columns $C_1$ . . . $C_5$ about the tray bottom (the rows and columns are defined when the greater longitudinal tray dimension extends vertically). The center row of ribs is commonly bisected by the longitudinal centerline 23 of the tray. All of the ribs extend in the longitudinal direction of the tray bottom. The ribs of successive rows $R_1$ . . . $R_5$ are arranged so that portions of ribs in successive rows overlap one another in the widthwise direction of the tray bottom. The ribs in the center row $R_3$ have the greatest overall dimensions (height, length, width), while those in rows $R_2$, $R_4$ and $R_1$,$R_5$ have progressively decreasing overall dimensions. Each of the illustrated ribs tapers in both height and width, but the taper may be in width or height only. Triangular profiled ribs are illustrated, but, as with the previous embodiment, other profiles may be employed.

Figure 6:
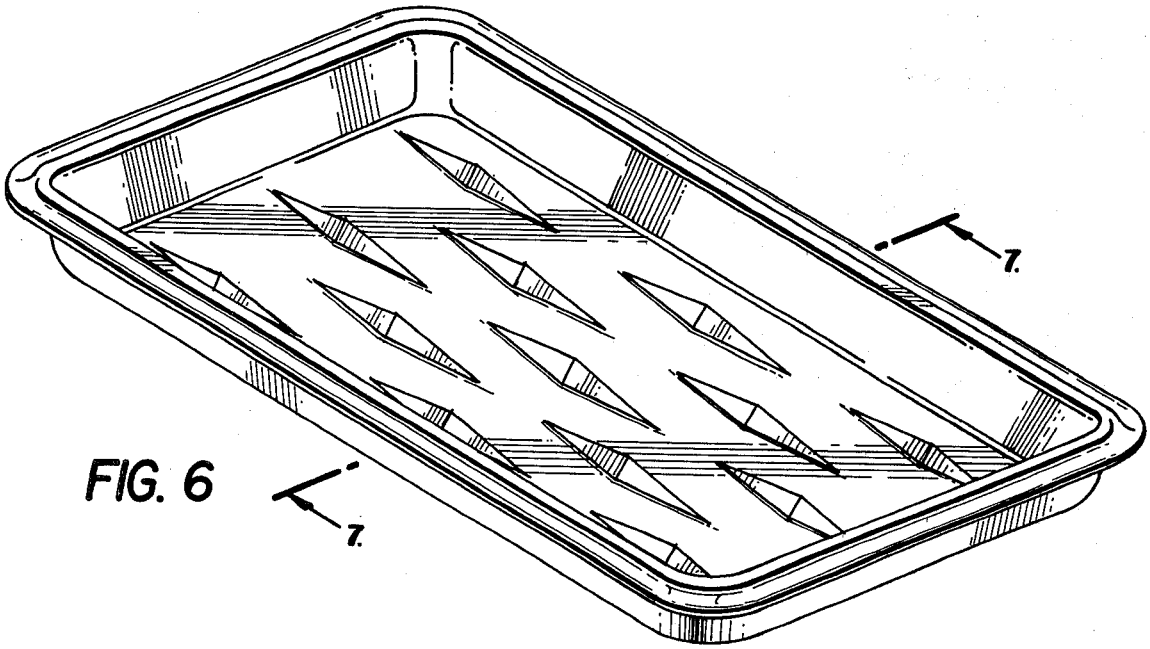
FIG. 6 is a perspective view of a third embodiment of a packaging tray of the invention.
Figure 7:
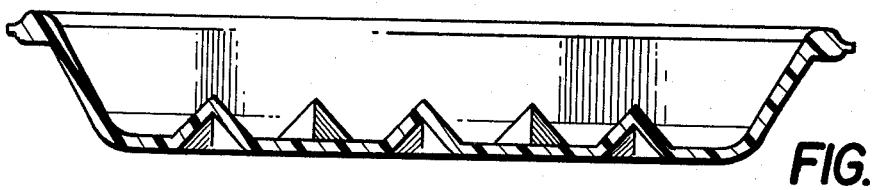
FIG. 7 is a cross-sectional view along the lines 7—7 in FIG. 6.

FIGS. 6 and 7 illustrate an embodiment which is a variant of that illustrated in FIGS. 4 and 5, in that all the ribs of the various rows $R_1$ . . . $R_5$ and columns $C_1$ . . . $C_5$ have the same overall dimensions.

Figure 8:
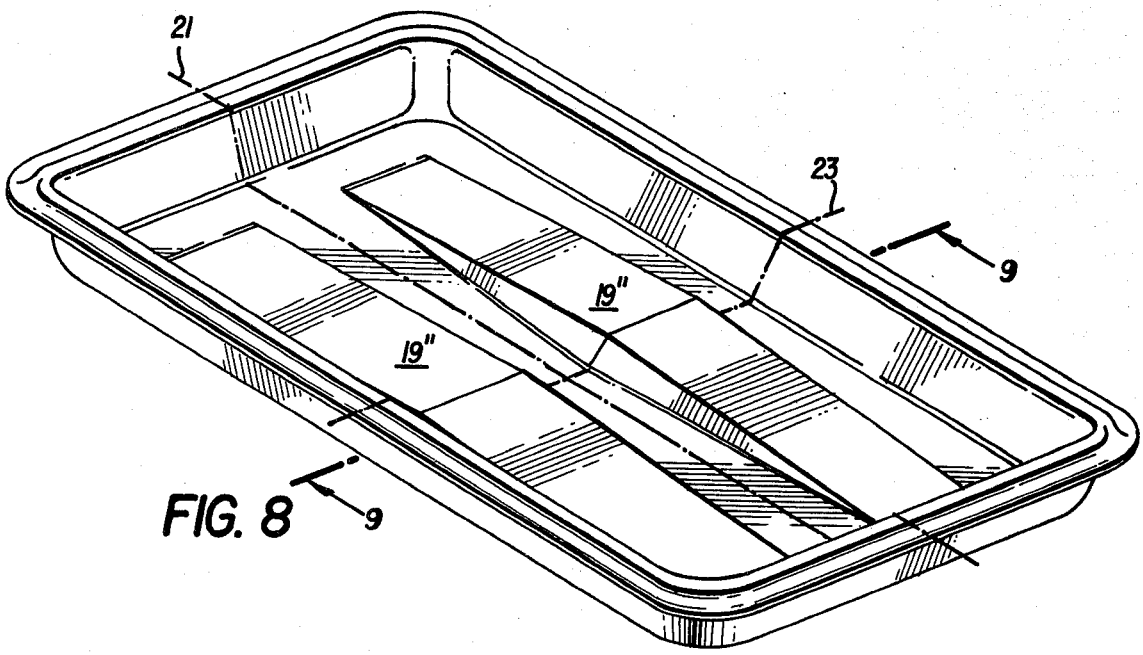
FIG. 8 is a perspective view of a fourth embodiment of a packaging tray of the invention; and, FIG. 9 is a cross-sectional view along the lines 9—9 in FIG. 8.
Figure 9:
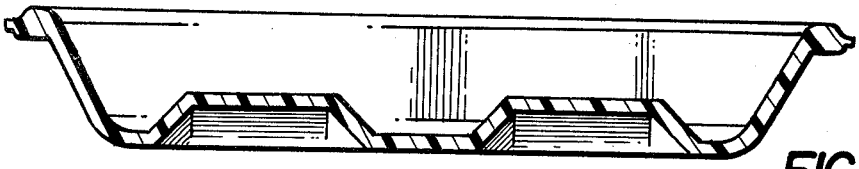

FIGS. 8 and 9 illustrate another embodiment of the invention which is similar to that of FIGS. 1–3, in that it employs a pair of spaced ribs 19" extending longitudinally of a tray. In this embodiment, the ribs have a flat top surface forming a trapezoidal cross-sectional rib profile. As in the FIGS. 1–3 embodiment, the ribs 19" taper both in height and width along their longitudinal extent.

Although various embodiments of the invention have been described and illustrated, it should be apparent that many modifications can be made thereto without departing from the spirit and scope of the invention. Accordingly, the invention is not limited by the foregoing description and illustrations, but is only limited by the scope of the claims appended hereto.

I claim:

1. An integral packaging tray comprising a generally rectangular bottom and sidewalls extending upwardly from edges of said bottom, said sidewalls being of substantially the same height and being integrally connected around the periphery of said bottom, said bottom containing at least one integrally formed reinforcing rib projecting upwardly therefrom and extending along said bottom from a substantially centerline portion of said bottom defined between two opposing sidewalls toward said two opposing sidewalls, said rib having a maximum cross-sectional dimension at said substantially centerline portion and tapering to a minimum cross-sectional dimension at its termination with a uniformly reducing cross-sectional dimension as it approaches said two opposing sidewalls.

2. A packaging tray as in claim 1, wherein each said rib terminates before reaching said two opposing sidewalls.

3. A packaging tray as in claim 1, wherein at least two of said ribs are provided extending along said bottom in parallel.

4. A packaging tray as in claim 1, wherein each said rib tapers in height as it extends from said centerline portion toward said two opposing sidewalls.

5. A packaging tray as in claim 1, wherein each said rib tapers in width as it extends from said substantially centerline portion toward said two opposing sidewalls.

6. A packaging tray as in claim 1, wherein each said rib tapers in height and width as it extends from said centerline portion toward said two opposing sidewalls.

7. A packaging tray as in claim 1, wherein the linear dimension of said bottom between said two opposing sidewalls exceeds the linear dimension of said bottom between other opposing sidewalls.

8. A packaging tray as in claim 1, wherein each said rib has a triangular cross-sectional profile.

9. A packaging tray as in claim 1, wherein each said rib has a trapezoidal cross-sectional profile.

10. A packaging tray as in claim 1, further comprising a plurality of ribs extending parallel to one another, said ribs being spaced symmetrically about a widthwise centerline portion of said tray.

11. A packaging tray as in claim 7, further comprising a plurality of tapered ribs spaced about said bottom, each of said ribs extending longitudinally in the direction of the greater linear dimension of said bottom.

12. A packaging tray as in claim 11, wherein said plurality of tapered ribs are arranged in rows and columns about said bottom when said tray is oriented so the greater dimension of said bottom extends vertically.

13. A packaging tray as in claim 12, wherein the ribs in one of said rows has their longitudinal centerlines coinciding with the longitudinal centerline portion of said bottom.

14. An integral packaging tray comprising a generally rectangular bottom and sidewalls extending upwardly from edges of said bottom, said sidewalls being of substantially the same height and being integrally connected around the periphery of said bottom, said bottom containing at least one integrally formed reinforcing rib projecting upwardly therefrom and extending along said bottom from a substantially centerline portion of said bottom defined between two opposing sidewalls toward said two opposing sidewalls, said rib having a maximum cross-sectional dimension at said substantially centerline portion and tapering with a reducing cross-sectional dimension as it approaches said two opposing sidewalls, the linear dimension of said bottom between said two opposing sidewalls being greater than the linear dimension of said bottom between two other opposing sidewalls, said tray further comprising additional ribs spaced about said bottom, each of said additional ribs extending longitudinally in the direction of the greater linear dimension of said bottom, all of said ribs being arranged in rows and columns about said bottom when said tray is oriented so the greater dimension of said bottom extends vertically, the ribs in one of said rows having their longitudinal centerlines coinciding with said substantially longitudinal centerline portion of said bottom, the ribs of successive rows being arranged so that portions thereof overlap one another in a widthwise direction of said bottom.

15. A packaging tray as in claim 14, wherein an odd number of rib rows is provided.

16. A packaging tray as in claim 14, wherein an odd number of rib columns is provided.

17. A packaging tray as in claim 14, wherein each of the ribs has the same overall dimensions.

18. A packaging tray as in claim 14, wherein the ribs in said one row are dimensionally larger than the ribs in others of said rows.

19. An integral packaging tray comprising a generally rectangular bottom and sidewalls extending upwardly from edges of said bottom, said sidewalls being of substantially the same height and being integrally connected around the periphery of said bottom, said bottom containing at least one integrally formed reinforcing rib projecting upwardly therefrom and extending along said bottom from a substantially centerline portion of said bottom defined between two opposing sidewalls toward said two opposing sidewalls, said rib having a maximum cross-sectional dimension at said substantially centerline portion and tapering with a reducing cross-sectional dimension as it approaches said two opposing sidewalls, each said rib tapering in width as it extends from said substantially centerline portion toward said two opposing sidewalls.

20. A packaging tray as in claim 19, wherein each said rib tapers in height and width as it extends from said centerline portion toward said two opposing sidewalls.

* * * * *